US007128405B2

(12) United States Patent
Suzuki

(10) Patent No.: US 7,128,405 B2
(45) Date of Patent: Oct. 31, 2006

(54) INKJET HEAD HAVING LAMINATED PIEZOELECTRIC ACTUATOR

(75) Inventor: Yoshihumi Suzuki, Ena (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 102 days.

(21) Appl. No.: 10/650,026

(22) Filed: Aug. 26, 2003

(65) Prior Publication Data

US 2004/0041886 A1 Mar. 4, 2004

(30) Foreign Application Priority Data

Aug. 29, 2002 (JP) ..... P2002-250395

(51) Int. Cl.
*B41J 2/045* (2006.01)

(52) U.S. Cl. ..... 347/72; 347/71

(58) Field of Classification Search ..... 347/50, 347/68–73; 310/365, 366
See application file for complete search history.

(56) References Cited

U.S. PATENT DOCUMENTS

| | | | | |
|---|---|---|---|---|
| 4,752,788 | A | 6/1988 | Yasahara et al. | |
| 4,766,671 | A * | 8/1988 | Utsumi et al. | 29/848 |
| 5,402,159 | A | 3/1995 | Takahashi et al. | |
| 5,605,659 | A * | 2/1997 | Moynihan et al. | 264/430 |
| 5,872,026 | A * | 2/1999 | Pasch | 438/109 |
| 6,174,051 | B1 * | 1/2001 | Sakaida | 347/72 |
| 6,367,916 | B1 * | 4/2002 | Asano | 347/69 |
| 6,378,996 | B1 * | 4/2002 | Shimada et al. | 347/70 |
| 6,655,790 | B1 * | 12/2003 | Takahashi | 347/72 |
| 6,715,862 | B1 * | 4/2004 | Takagi et al. | 347/72 |
| 2002/0196315 | A1 | 12/2002 | Isono et al. | |

FOREIGN PATENT DOCUMENTS

| | | |
|---|---|---|
| EP | 0 736 386 A2 | 10/1996 |
| EP | 1 013 428 A | 6/2000 |
| JP | 3128857 | 11/1992 |
| JP | 09-162450 | 6/1997 |
| JP | P2002-19102 | 1/2002 |
| JP | P2003-80709 | 3/2003 |

* cited by examiner

*Primary Examiner*—Stephen Meier
*Assistant Examiner*—Geoffrey S. Mruk
(74) *Attorney, Agent, or Firm*—Reed Smith LLP

(57) ABSTRACT

A common electrode formed on the lowest piezoelectric sheet has a shape corresponding to drive electrodes, and lead-out parts of the common electrode have a shape corresponding to projecting parts of the drive electrodes. Because the common electrode formed on the lowest piezoelectric sheet is made large enough to include the projected contours in the horizontal plane of the drive electrodes together with their lead-out parts, the common electrode lies between the cavity plate and the drive electrodes nearest to the cavity plate. Therefore, the voltage applied to the drive electrode is restricted from leaking to the cavity plate.

25 Claims, 12 Drawing Sheets

INKJET HEAD HAVING LAMINATED PIEZOELECTRIC ACTUATOR

BACKGROUND OF THE INVENTION

1. Field of the Invention

The present invention relates to an inkjet print head that is able to eject ink more stable and easy to assemble during manufacture.

2. Related Art

Drop-on-demand inkjet print head disclosed in U.S. Pat. No. 5,402,159 includes a cavity unit and a piezoelectric actuator. The cavity unit is formed with a plurality of nozzles for ejecting ink and a plurality of pressure chambers in one-to-one correspondence with the nozzles. The piezoelectric actuator includes a plurality of piezoelectric ceramic sheets on which drive electrodes are formed and a plurality of piezoelectric ceramic sheets on which common electrodes are formed. The piezoelectric ceramic sheets with the drive electrodes and the piezoelectric ceramic sheets with the common electrodes are stacked one on the other in alternation. Portions of each piezoelectric ceramic sheet sandwiched between the drive electrodes and the common electrode serve as active portions. The piezoelectric actuator is fixed to the cavity unit such that the active portions are in correspondence with the pressure chambers. By selectively activating (deforming) the active portions, ink is ejected from the corresponding nozzles.

The present applicant has proposed in Japanese Patent-Application Publication No. 2002-19102 an inkjet print head having a cavity unit made from an electrically-conducting material and a piezoelectric actuator whose lowest piezoelectric ceramic sheet is fixed to and in contact with the cavity unit. Drive electrodes are disposed on the lowest piezoelectric ceramic sheet, and a common electrode is disposed on a second piezoelectric ceramic sheet from the bottom. That is, the common electrode closest to the cavity unit is disposed above the drive electrodes via the second ceramic sheet. Each piezoelectric ceramic sheet has a thin thickness of 20 μam to 30 μm. With this configuration, a voltage applied to the drive electrode on the lowest piezoelectric sheet is adversely applied to the cavity unit via the thin lowest piezoelectric sheet and also to water-soluble, i.e., conductive ink, contained in pressure chambers formed in the cavity unit. As a result, when a voltage is applied to a drive electrode in order to eject ink from a corresponding pressure chamber, electric current conducts through the piezoelectric ceramic sheet, the cavity unit, and the ink, to a different drive electrode corresponding to an adjacent pressure chamber. This gives rise to the problem of unstable ejection of ink, and ink being ejected from unintended adjacent pressure chamber.

SUMMARY OF THE INVENTION

In the view of foregoing, it is an object of the present invention to overcome the above problems, and also to provide an inkjet print head in which the unwanted capacitance is more effectively prevented resulting in more stable ink injection, and that improves the manufacturability by simplifying the assembly process.

In order to attain the above and other objects, the present invention provides an inkjet head and an inkjet printer including the inkjet head and a frame that supports the inkjet head. The inkjet head includes a cavity unit and an actuator. The cavity unit is formed of a conductive material with a plurality of nozzles and a plurality of pressure chambers in fluid communication with the corresponding nozzles. The actuator includes a plurality of sheet members laminated one on the other in a stacked direction, a plurality of drive electrodes corresponding to the pressure chambers, and a plurality of common electrodes. The plurality of drive electrodes and the plurality of common electrodes are arranged in alternation with respect to the stacked direction. Each of the drive electrodes and the common electrodes is sandwiched between corresponding sheet members. Portions of the sheet members sandwiched between the drive electrodes and the common electrodes serve as active portions that selectively eject ink droplets from the corresponding pressure chambers through the nozzles. Projected contours of all the drive electrodes fall within a projected contour of one of the common electrodes disposed closest to the cavity unit with respect to the stacked direction.

PREFERRED EMBODIMENTS OF THE PRESENT INVENTION

Next, a preferred embodiment of the present invention will be described while referring to the attached drawings.

Figure 1:
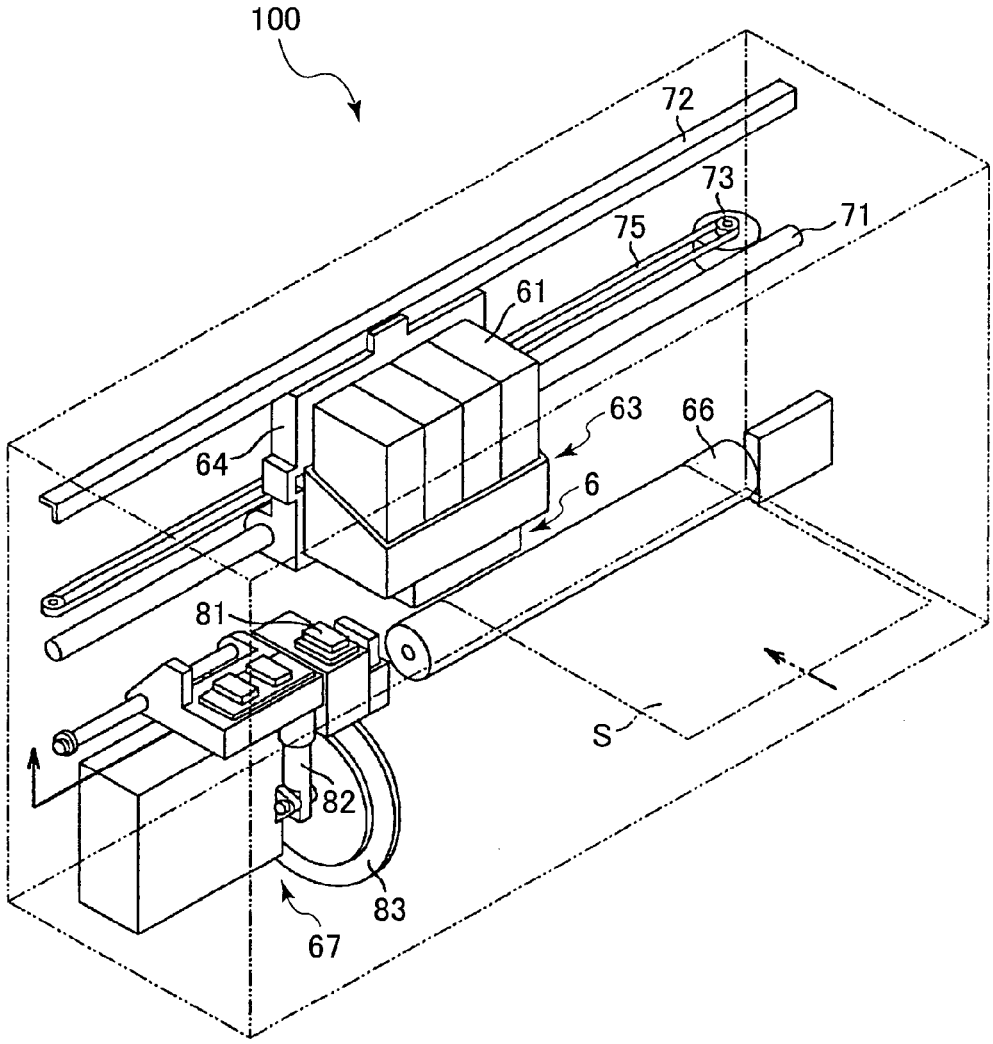
FIG. 1 is a perspective view showing internal configuration of an inkjet printer including inkjet print heads according to an embodiment of the present invention.

FIG. 1 shows a color inkjet printer 100 mounting a pair of inkjet heads 6 according to an embodiment of the present invention. The inkjet heads 6 eject ink droplets through nozzles 54 (FIG. 2) for forming images on a recording sheet S. First, an overall configuration of the color inkjet printer 100 will be described.

As shown in FIG. 1, the color inkjet printer 100 includes a carriage 64 that mounts a head unit 63 and ink cartridges 61. The head unit 63 includes a pair of inkjet heads 6. The carriage 64 is connected to an endless belt 75.

When a motor (not shown) drives a pulley 73 to rotate in forward and reverse directions, the carriage 64 moves reciprocally in association with forward and reverse movement of the pulley 73, and linearly following a carriage shaft 71 and a guide plate 72.

Although not shown in the drawings, the color inkjet printer 100 is also provided with a sheet supply mechanism, a sheet discharge mechanism, and a cassette. The cassette is provided at the side of the printer 100 and mounts the recording sheets S thereon. The sheet supply mechanism introduces the recording sheets S mounted on the cassette one at a time to a position between the piezoelectric inkjet print heads 6 and a platen roller 66. After the piezoelectric inkjet print heads 6 form characters and the like onto the recording sheet S, the sheet discharge mechanism discharges the recording sheet S out of the printer 100.

A purge unit 67 is provided to the side of the platen roller 66. The purge unit 67 includes a cap 81, a pump 82, and a cam 83, and performs a purging operation on the inkjet heads 6 in order to recover the inkjet heads 6 to a good condition when the head unit 63 is in a prescribed reset position. In the purging operation, the cap 81 covers over the nozzles 54 of the inkjet heads 6. Then, the cam 83 drives the pump 82 to suck defective ink containing bubbles and the like from the inkjet heads 6 through the nozzles 54.

Next, detailed description will be provided for the head unit 63.

Figure 4:
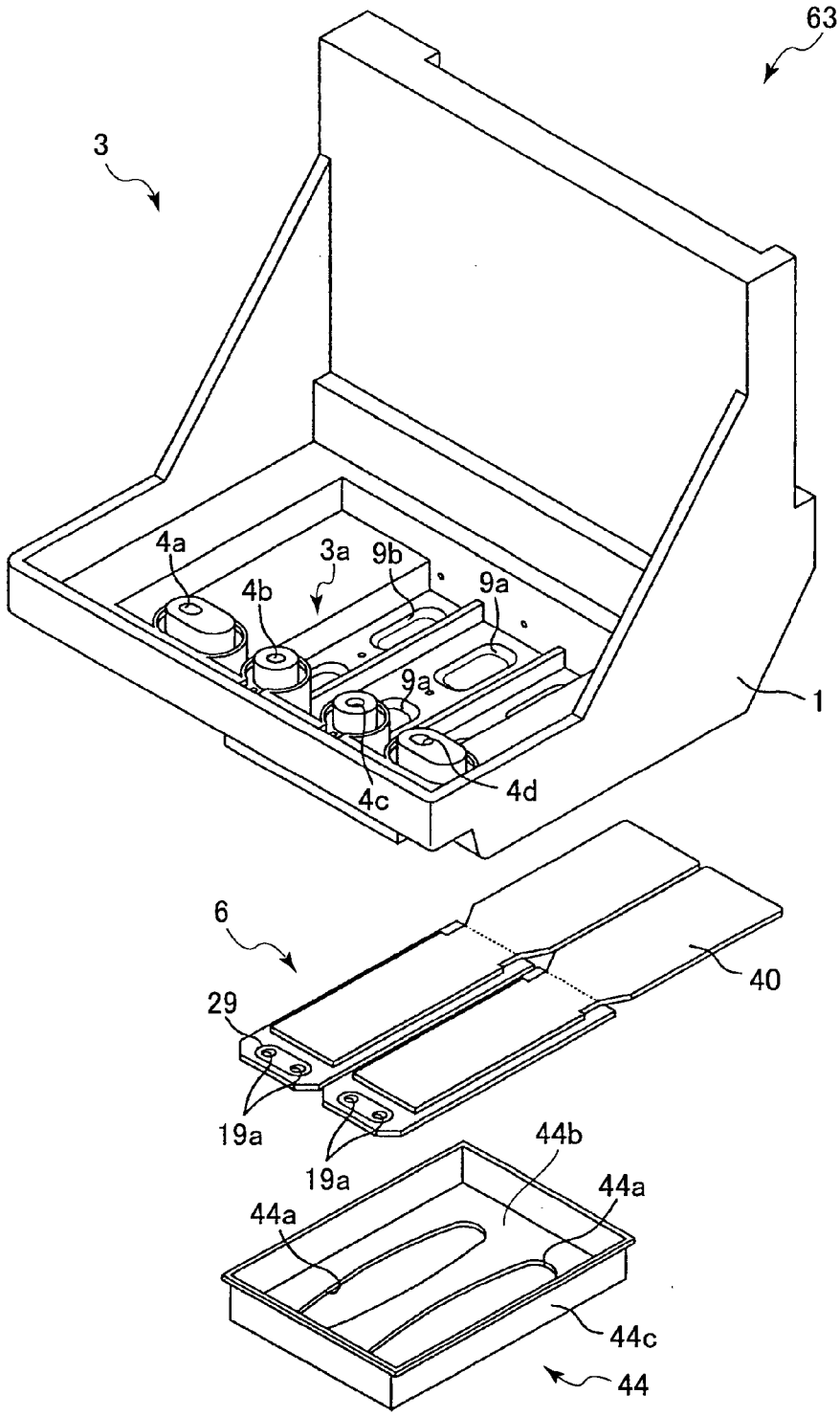
FIG. 4 is an exploded perspective view showing the head unit of FIG. 2 as viewed from the above.

As shown in FIG. 4, the head unit 63 includes a frame 1, the inkjet heads 6, and a cover plate 44. The frame 1 is mounted on the carriage 64 and formed of compound resin, such as polyproethylene or polypropylene, by ejection molding. The frame 1 has a substantial box shape with the upper part open, where a mounting portion 3 is formed for mounting the ink cartridges 61 in a freely detachable manner. The frame 1 includes a bottom wall 3*a* formed with ink supply holes 4*a*, 4*b*, 4*c*, 4*d* penetrating therethrough. Although not shown in the drawings, the cartridges 61 are formed with an ink outlet portion to which the corresponding ink supply hole 4*a*, 4*b*, 4*c*, 4*d* is connected.

Figure 3:
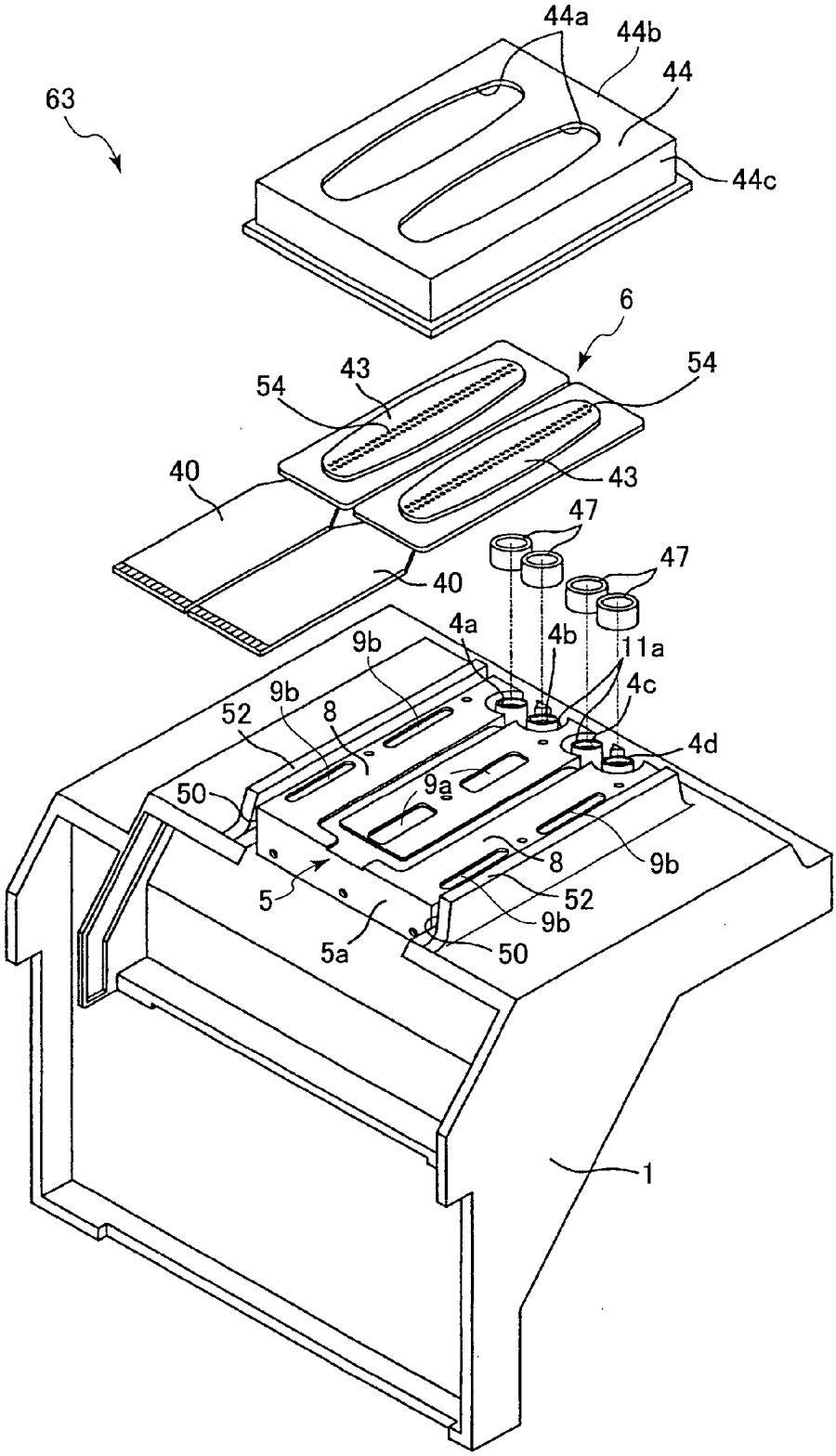
FIG. 3 is an exploded perspective view showing the head unit of FIG. 2.

As shown in FIG. 3, the bottom wall 3*a* includes a bottom plate 5 provided to its bottom side. The bottom plate 5 has a flat surface and protrudes downward from the rest of the mounting portion 3. Two support portions 8, 8 are formed in the bottom plate 5 for supporting the inkjet heads 6 thereon. A plurality of empty portions 9*a*, 9*b* are formed penetrating through the support portions 8, 8 for holding a UV adhesive that fixes the inkjet heads 6 in place.

8-shaped engagement grooves 11*a* are formed surrounding the ink supply holes 4*a*, 4*b*, 4*c*, 4*d*. Ring-shaped packing 47 formed of rubber or the like are inserted into the engagement grooves 11*a*. When the inkjet heads 6 are fixed to the frame 1, the tip end of the packing 47 is pressed to the outer periphery of an inlet port 19*a* (FIGS. 5 and 7) of the inkjet heads 6 for developing an intimate sealed condition with the inlet port 19*a*.

Figure 5:
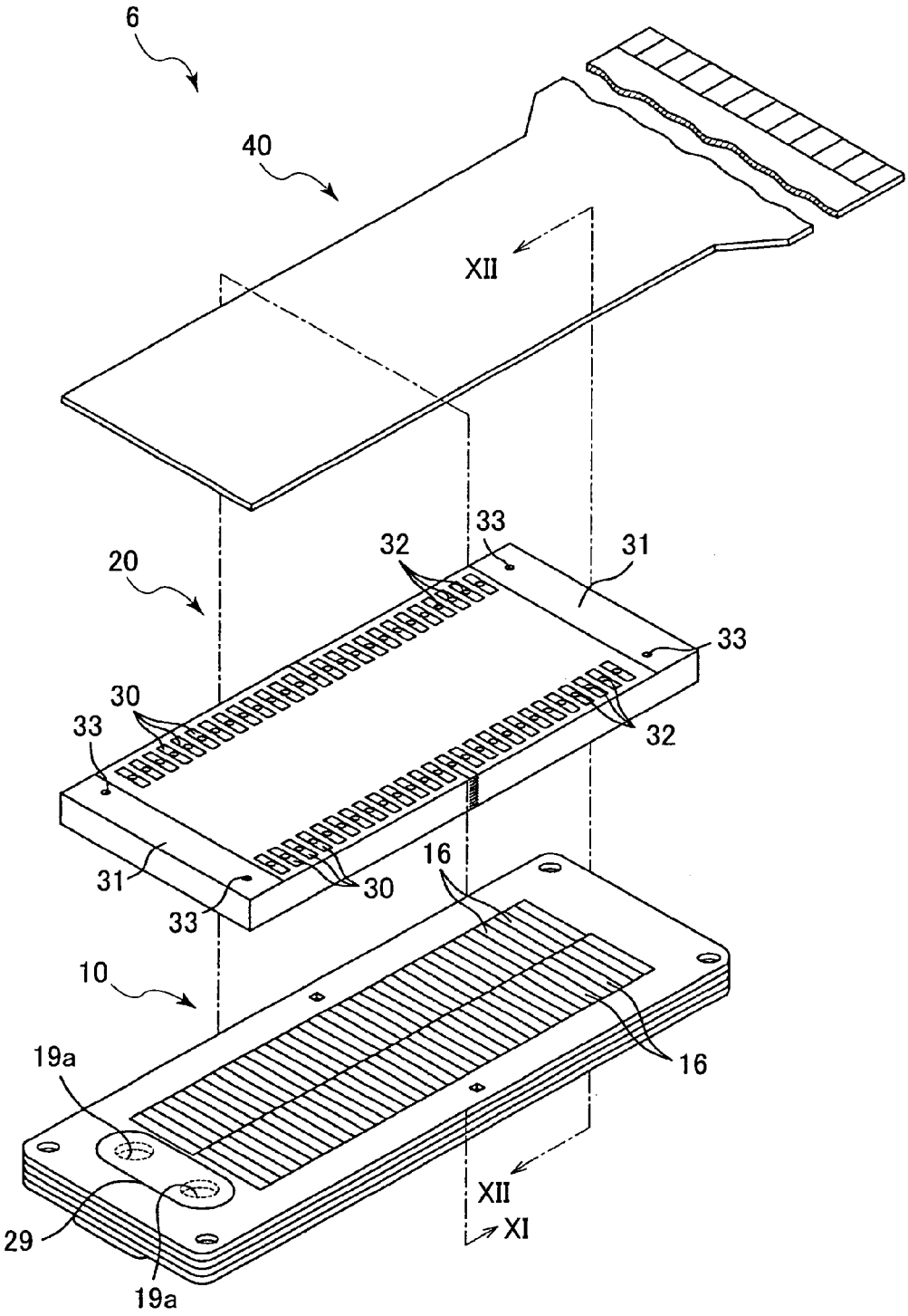
FIG. 5 is an exploded perspective view of the inkjet print head.

As shown in FIG. 5, each inkjet head 6 includes a cavity unit 10, a plate-shaped piezoelectric actuator 20, and a flexible flat cable 40.

The cavity unit 10 is a stack of a plurality of layers. The actuator 20 is adhered in a stacked condition onto the cavity unit 10. The flexible flat cable 40 is stacked on the actuator 20 and electrically connected to external equipment.

Figure 6:
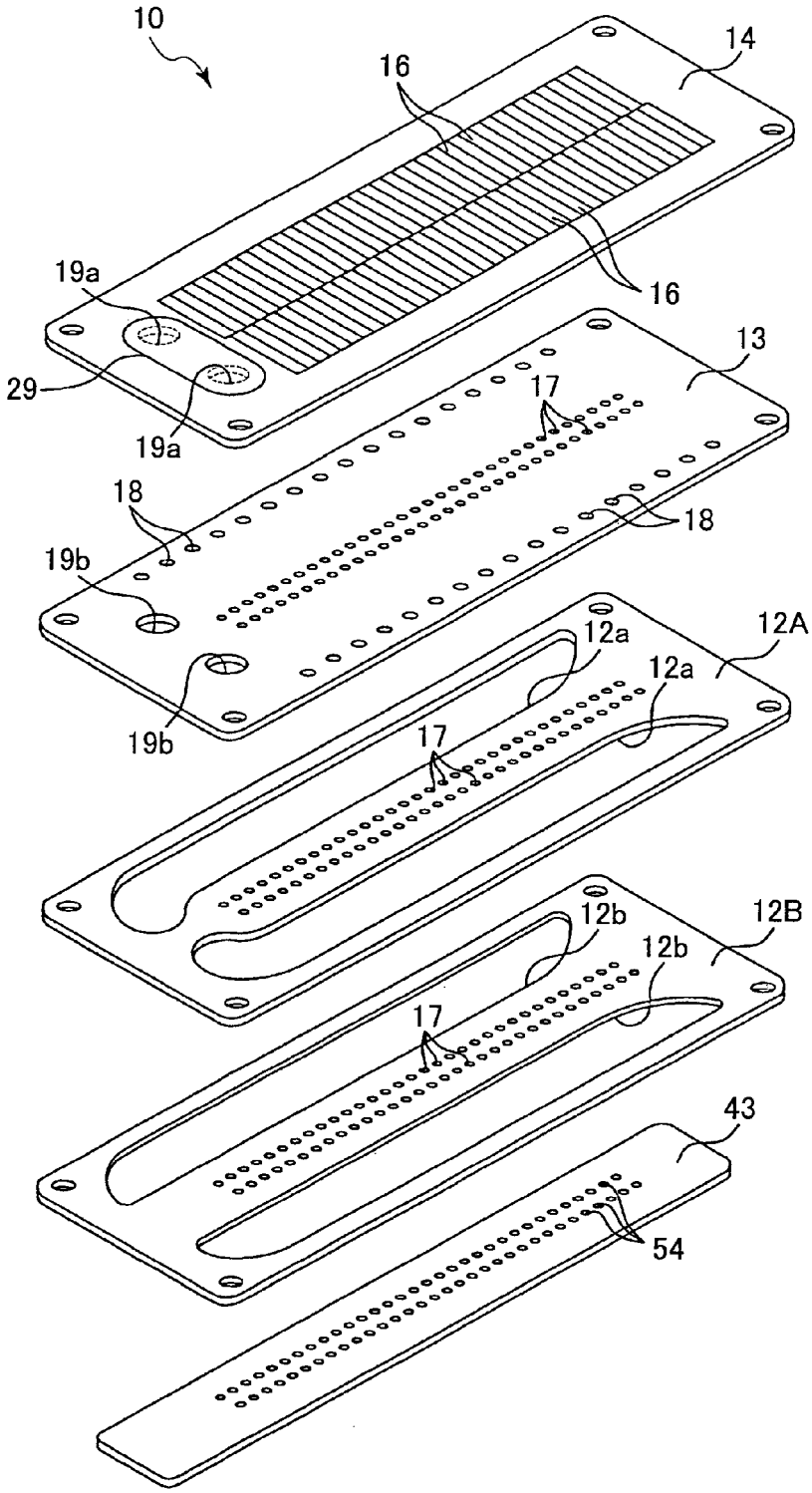
FIG. 6 is an exploded perspective view of a cavity unit of the inkjet print head.

As shown in FIG. 6, the cavity unit 10 includes a nozzle plate 43 at its bottom end. The nozzle plate 43 is formed with the nozzles 54 through which ink is ejected downward.

Figure 2:
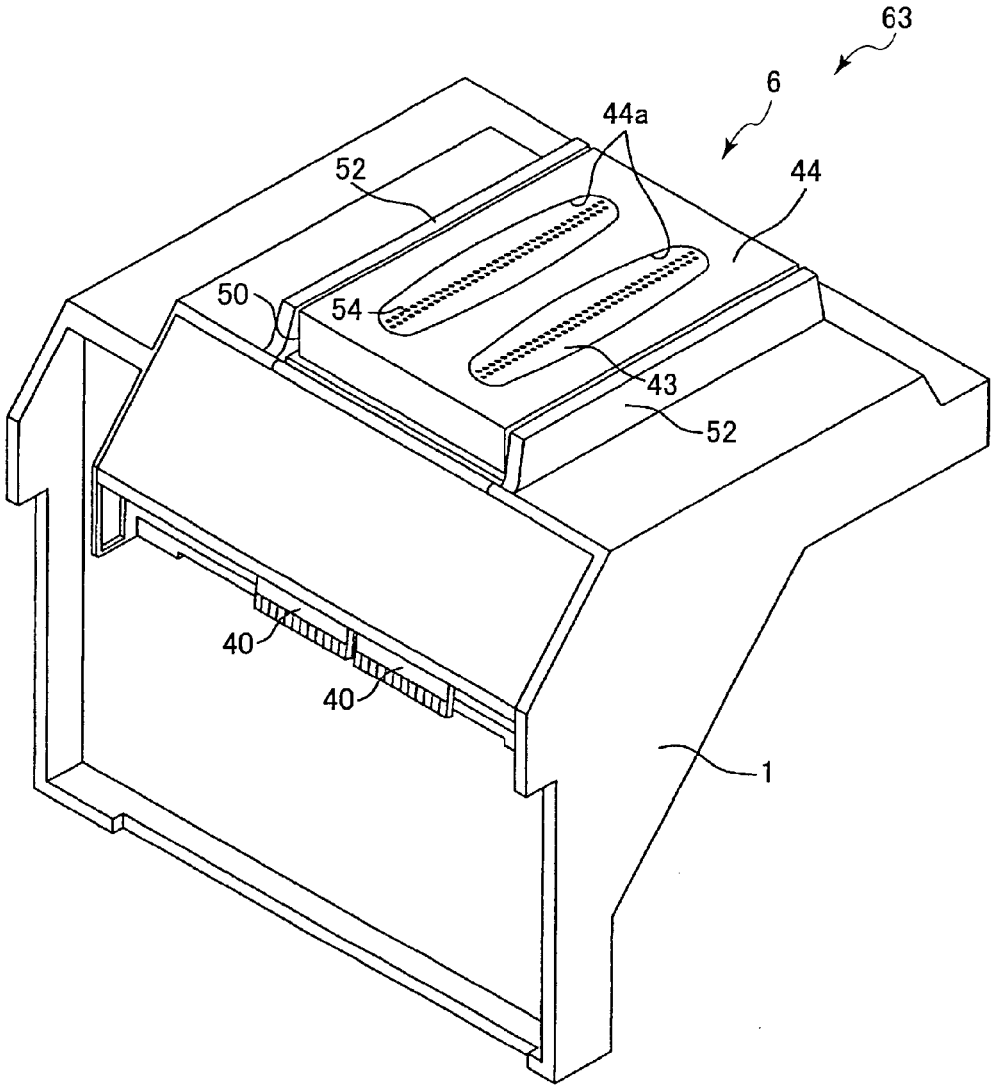
FIG. 2 is a perspective view showing the bottom of a head unit of the inkjet printer of FIG. 1.

As shown in FIGS. 2 to 4, the cover plate 44 is placed to cover the inkjet heads 6, and includes a bottom wall 44*b* and side walls 44*c* extending upward from the edges of the bottom wall 44*b* to form a box shape. The bottom wall 44*b* is formed with a pair of openings 44*a* through which the nozzle plates 43 of the inkjet heads 6 are exposed outside.

As shown in FIG. 3, the frame 1 is formed with a pair of ribs 52, 52, defining grooves 50 between the ribs 52, 52 and the side surfaces of the bottom plate 5. The side walls 44*c* of the cover plate 44 are received into the grooves 50 and fixed by an adhesive thereto.

Figure 7:
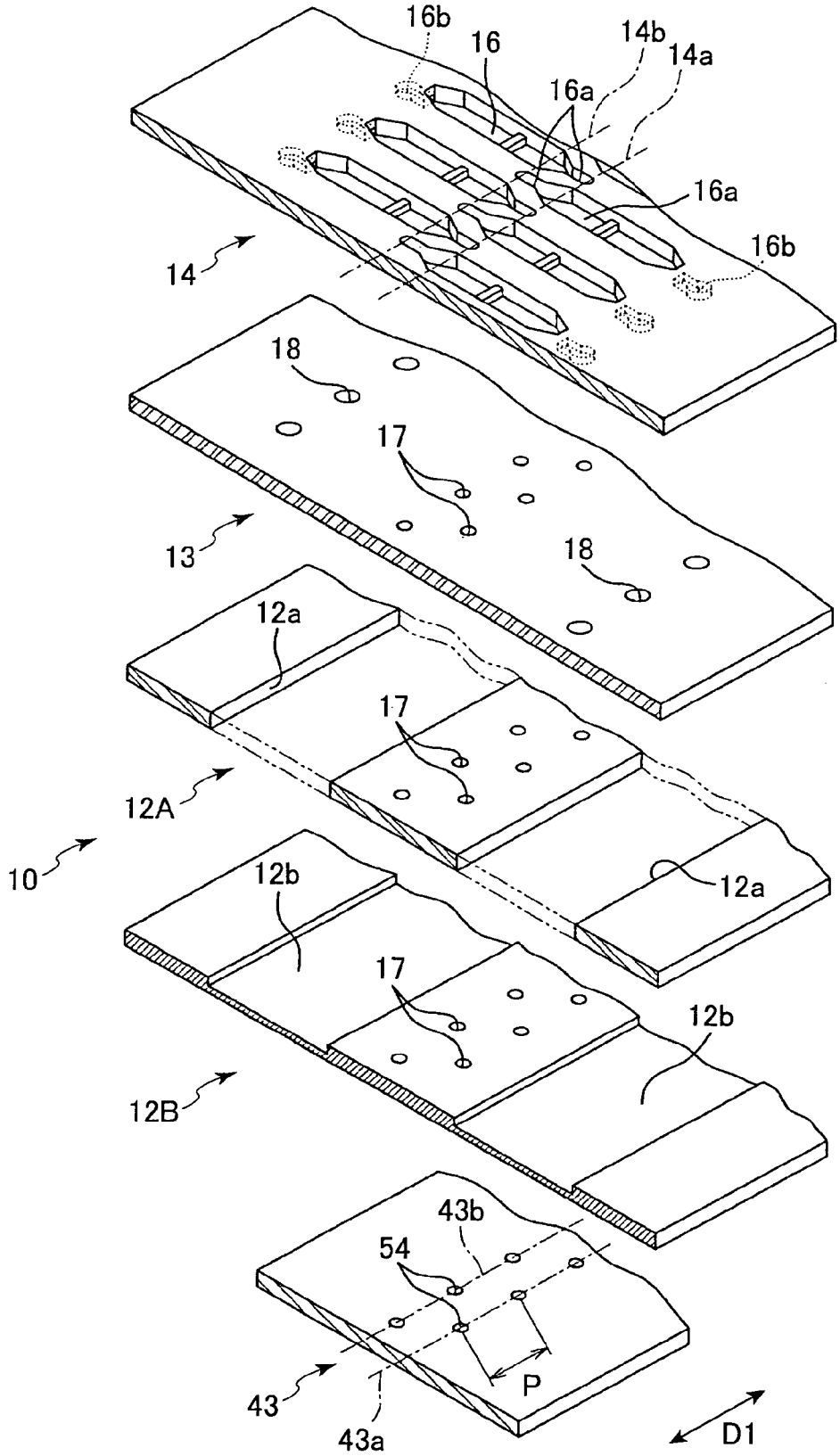
FIG. 7 is a magnified exploded perspective partial view of the cavity unit of FIG. 6.

Next, detailed description of the inkjet head 6 will be provided. As described above, the inkjet head 6 includes the cavity unit 10, the piezoelectric actuator 20, and the flexible flat cable 40. As shown in FIGS. 6 and 7, the cavity unit 10 includes five electrically conductive thin plates connected in a laminated manner by adhesive. The five plates include the nozzle plate 43, a pair of manifold plates 12B, 12A, a spacer plate 13, and a cavity plate 14 in this order from the bottom side. The plates 12B, 12A, 13, 14 are formed from a 42% nickel-alloy steel to a thickness of between 50 μm to 150 μm.

The nozzle plate 43 is formed with the plurality of nozzles 54, through which ink droplets are ejected. As shown in FIG. 7, the nozzles 54 are formed separated from each other by a pitch P in two rows aligned following central imaginary lines 43*a*, 43*b* that extend in a lengthwise direction D1. The rows of nozzles 54 are shifted slightly in the lengthwise direction D1 to give the nozzles 54 a staggered arrangement.

Narrow-width pressure chambers 16 are formed in the cavity plate 14 in two rows that extend parallel with imaginary lines 14*a*, 14*b*, which extend in the center of the cavity plate 14 along the lengthwise direction D1 of the cavity plate 14. Tip ends 16a of right-sided pressure chambers 16 are located on the line 14*b*, whereas tip ends 16*a* of left-sided pressure chambers 16 are located on the line 14*a*. A groove 16*b* is formed in a lower surface of the cavity plate 14 at one end of each pressure chamber 16. As shown, the right-sided pressure chambers 16 and the left-sided pressure chambers 16 are arranged in alternation in the direction D1 so as to give the pressure chambers 16 a staggered arrangement.

Small-diameter through holes 17 are formed through the spacer plate 13 and the manifold plates 12A, 12B, in the same staggered arrangement as the nozzles 54. The tip end 16*a* of each pressure chamber 16 is in fluid communication with one of the nozzles 54 through the corresponding through holes 17. As shown in FIG. 6, ink supply holes 19*a*, 19*b* are formed through the cavity plate 14 and the spacer plate 13, respectively, in a vertical alignment. A filter 29 is attached onto the upper surface of the cavity plate 14 for covering the ink supply holes 19*a*. Ink supply holes 18 are formed through the left and right sides of the spacer plate 13 at positions vertically aligned with the ink supply holes 16*b* (FIG. 7).

Figure 11:
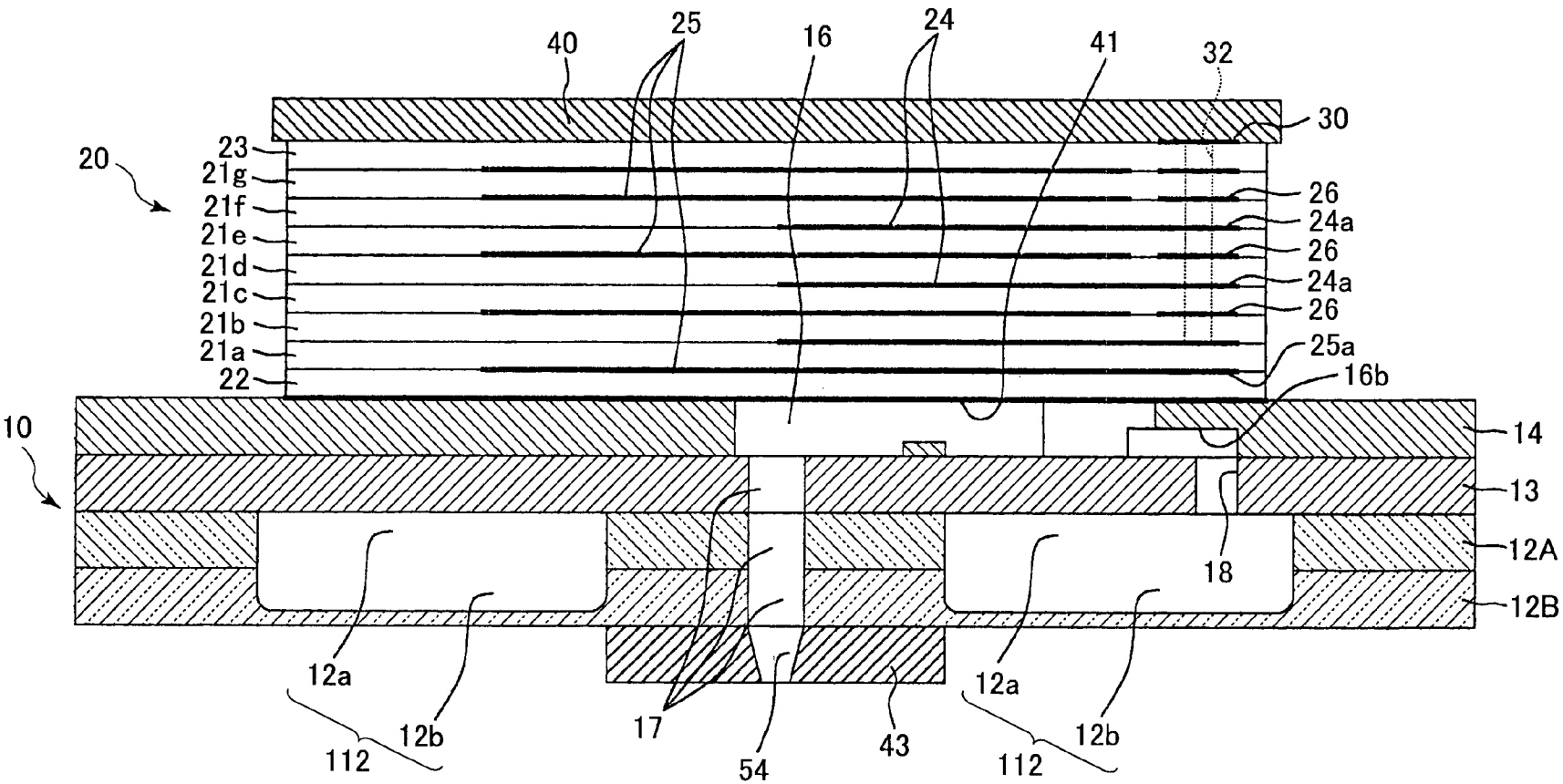
FIG. 11 is a cross-sectional view of the inkjet print head taken along a line XI—XI of FIG. 5.

The manifold plate 12A is formed with a pair of manifold chambers 12*a*, 12*a*, penetrating through the manifold plate 12A, at positions sandwiching the rows of through holes 17. A pair of chamber grooves 12*b*, 12*b* are formed in the upper surface of the manifold plate 12B at positions corresponding to the manifold chambers 12*a*, 12*a* while sandwiching the rows of through holes 17. When the manifold plates 12A and 12B are adhered to each other, then the manifold chambers 12*a*, 12*a* and the corresponding manifold grooves 12*b*, 12*b* together define a pair of manifolds 112 (FIG. 11).

With this configuration, ink supplied from the ink cartridge 61 flows through the ink supply holes 19*a*, 19*b* into the manifold 112, and is distributed through the ink supply holes 18 and 16*b* into the pressure chambers 16. The ink further flows toward the tip ends 16*a* of the pressure chambers 16 and through the through holes 17 into the nozzles 54 corresponding to the pressure chambers 16.

Figure 8:
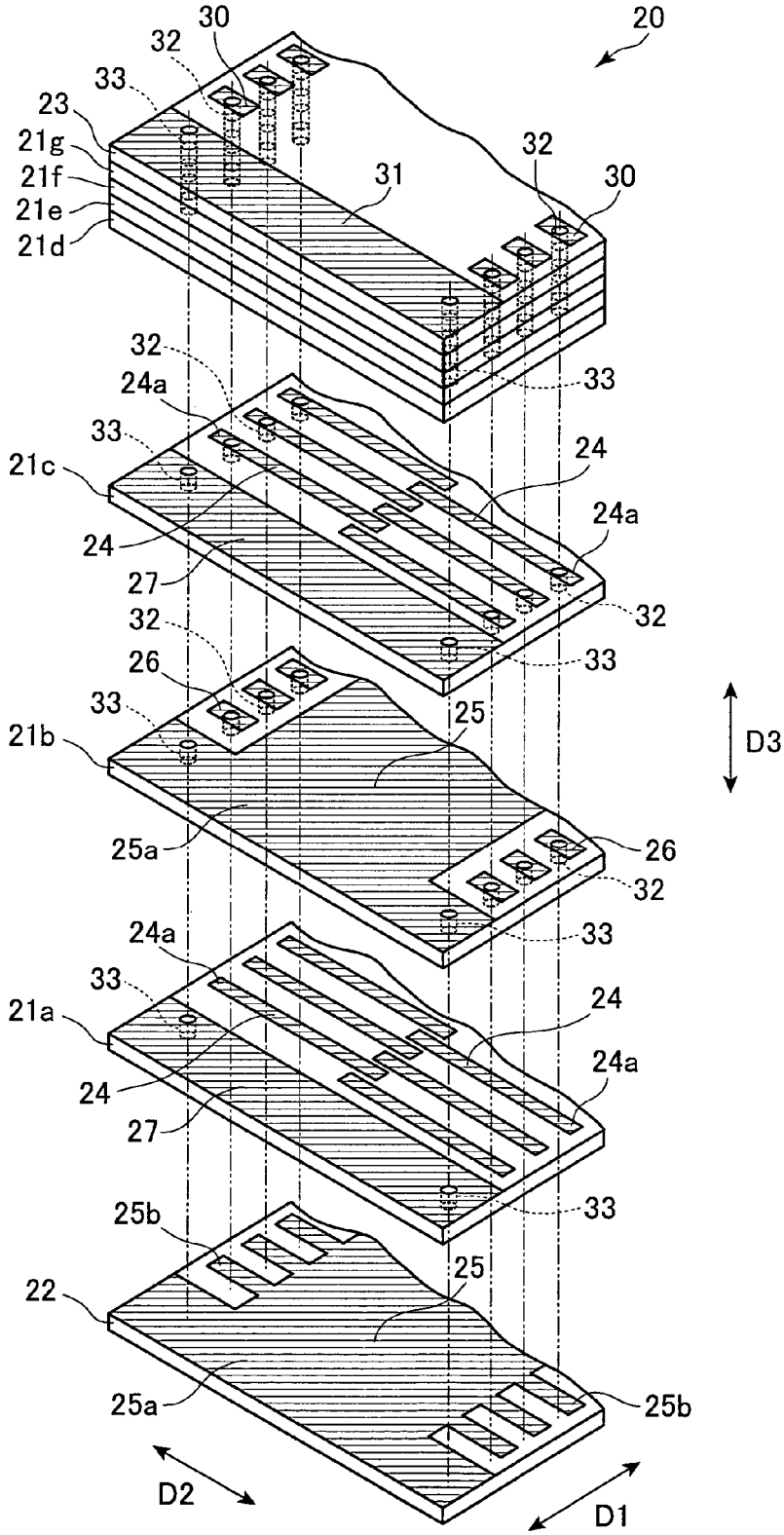
FIG. 8 is an exploded perspective partial view of an actuator of the inkjet print head.

Next, the actuator 20 will be described in detail. As shown in FIG. 8, the actuator 20 includes nine piezoelectric sheets 22, 21*a*, 21*b*, 21*c*, 21*d*, 21*e*, 21*f*, 21*g*, 23 stacked in this order from the bottom in a stacked direction D3, which is a vertical direction in this embodiment, to give a laminated configuration. Each piezoelectric sheet 22, 21*a*–21*g*, and 23 is made of ceramic to a thickness of about 30 μm and a length greater than the entire width of the pressure chambers 16 in the direction D1. The lowest sheet 22 and the uppermost sheet 23 could be formed of insulation material rather than piezoelectric ceramic material.

As shown in FIG. 8, narrow width drive electrodes 24 are formed on the upper surface of each piezoelectric sheet 21*a*, 21*c*, 21*e*. Each drive electrode 24 is in vertical alignment with the corresponding pressure chamber 16 formed in the cavity unit 10. The drive electrodes 24 are aligned in the direction D1, and each drive electrode 24 extends in a direction D2 perpendicular to the direction D1. Each drive electrode 24 has a width in the direction D1 slightly narrower than the width of the corresponding pressure chamber 16 and a length in the direction D2 longer than the length of the corresponding pressure chamber 16. Each drive electrode 24 has a protruding portion 24*a* extending beyond the corresponding pressure chamber 16 outwardly in the direction D2. Dummy electrodes 27 are formed on the upper surface of the piezoelectric sheets 21*a*, 21*c*, and 21*e* along the edges extending in the direction D2 across the entire width in the direction D2.

Common electrodes 25 are formed on the upper surfaces of the piezoelectric sheets 21*b*, 21*d*, 21*f*, and 21*g*, serving as common electrodes for all of the pressure chambers 16. The common electrodes 25 are formed in an approximately rectangular band shape at the center of the direction D2 to have a dimension with sufficient width and length in the directions D1 and D2 for covering all of the pressure chambers 16 arranged in two rows. The common electrode 25 has lead-out parts 25*a* each having a length substantially equivalent to and extending along an edge of the corresponding piezoelectric sheet 21*b*, 21*d*, 21*f*, and 21*g* in the direction D2. The lead out part 25*a* is in vertical alignment with the corresponding dummy electrodes 27.

A plurality of dummy electrodes 26 are provided on the upper surface of the piezoelectric sheets 21*b*, 21*d*, 21*f*, and 21*g* where the common electrodes 25 are provided. The dummy electrodes 26 are in vertical alignment with the corresponding protruding portions 24*a*, and each has the same width as the protruding portions 24*a* in the direction D1 and a length shorter than the protruding portions 24*a* in the direction D2. Each dummy electrode 26 is separated from the common electrode 25 by an appropriate distance in the direction D2.

Figure 9:
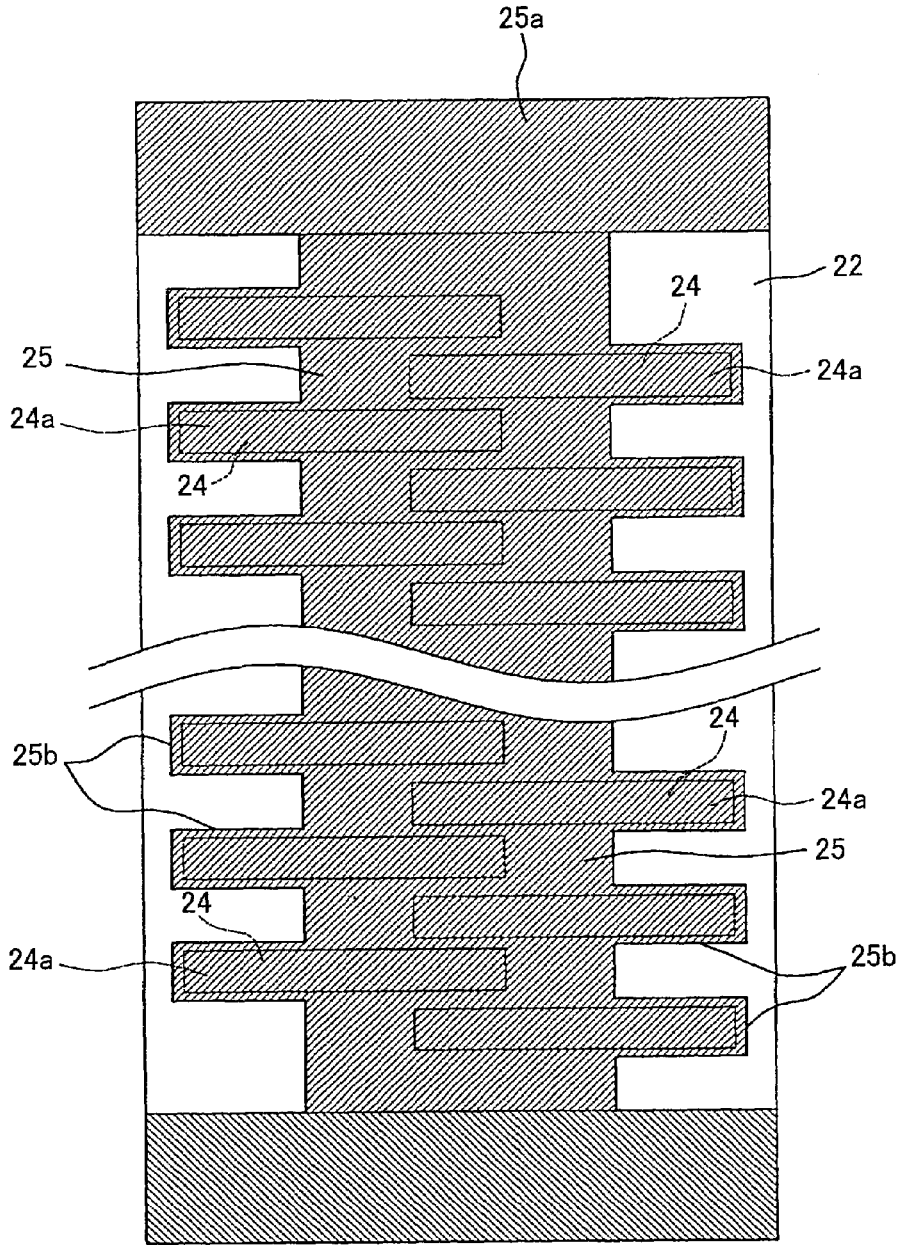
FIG. 9 is a plan view of a common electrode formed on a lowest piezoelectric sheet with contours of drive electrodes projected on the common electrode.

A common electrode 25 is also formed on the upper surface of the lowest piezoelectric sheet 22. The common electrode 25 on the lowest piezoelectric sheet 22 has a plurality of integrally-formed lead-out parts 25*a* and lead-out parts 25*b*. The lead-out parts 25*b* outwardly extend in the direction D2 from both sides of the common electrode 25. The lead-out parts 25*b* have almost the same shape as the dummy electrodes 26. FIG. 9 shows the common electrode 25 formed on the lowest piezoelectric sheet 22 and projected contours of the drive electrodes 24. As shown in FIG. 9, the common electrode 25 formed on the lowest piezoelectric sheet 22 is made large enough so that the projected contours of the drive electrodes 24 including the protrusion portions 24*a* fall within a projected contour of the common electrode 25 formed on the lowest piezoelectric sheet 22 as viewed from the stacked direction D3.

That is, the piezoelectric sheets 22, 21*b*, 21*d*, 21*f* each with the common electrode 25 and the piezoelectric sheets 21*a*, 21*c*, 21*e* each with the drive electrodes 24 are alternately laminated one on the other in the stacked direction D3. The common electrode 25 is formed on the upper surface of the piezoelectric sheet 21*g*, not the drive electrodes 24.

As shown in FIG. 8, on the upper surface of the piezoelectric sheet 23, there are provided first surface electrodes 30 in vertical alignment with the protruding portions 24*a* and second surface electrodes 31 in vertical alignment with the lead-out parts 25*a*.

The piezoelectric sheets 21*b*–21*g* and 23, except the piezoelectric sheets 22 and 21*a*, are formed with first through holes 32 in vertical alignment, penetrating through the first surface electrodes 30, the protruding portions 24*a*, and the dummy electrodes 26. The first through holes 32 are filled with conductive paste for electrically connecting the protruding portions 24*a* and the dummy electrodes 26 to the corresponding first surface electrodes 30. In the same manner, the piezoelectric sheets 21*a*–21*g* and 23, except the lowest piezoelectric sheet 22, are formed with second through holes 33 in vertical alignment, penetrating through the second surface electrodes 31, the dummy electrodes 27, and the lead-out parts 25*a*. The second through holes 33 are filled with conductive paste for electrically connecting the lead-out parts 25*a*, i.e., the common electrodes 25, and the dummy electrodes 27 to the corresponding second surface electrodes 31.

Figure 10:
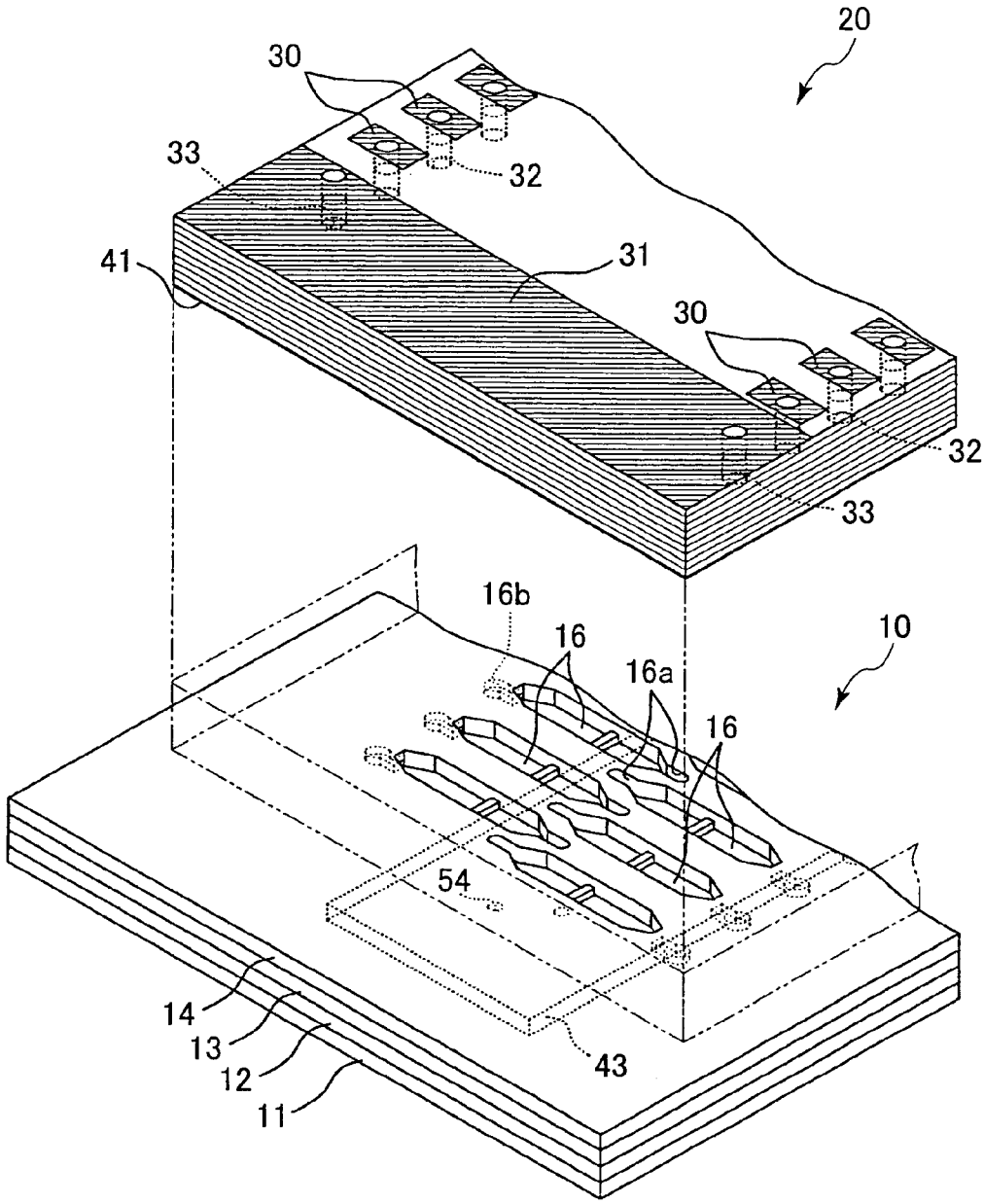
FIG. 10 is an exploded partial view of the inkjet print head.

The piezoelectric actuator 20 having the above configuration is fixed to the cavity unit 10 and the flexible flat cable 40 in the following manner. As shown in FIG. 10, an adhesive sheet 41, which is formed of non-ink-permeable compound resin or the like, serving as an adhesive layer, is attached onto the entire bottom surface of the lowest piezoelectric sheet 22 of the piezoelectric actuator 20. The material for the adhesive sheet 41 is non-ink-permeable and electrically insulative. Examples of such a material include a polyamide hot-melt adhesive including as main component a polyamide resin with a base of nylon or dimer acid, a polyester hot-melt adhesive in a film shape, and the like. The thickness of the adhesive sheet 41 is 1 μm to 3 μm.

Figure 12:
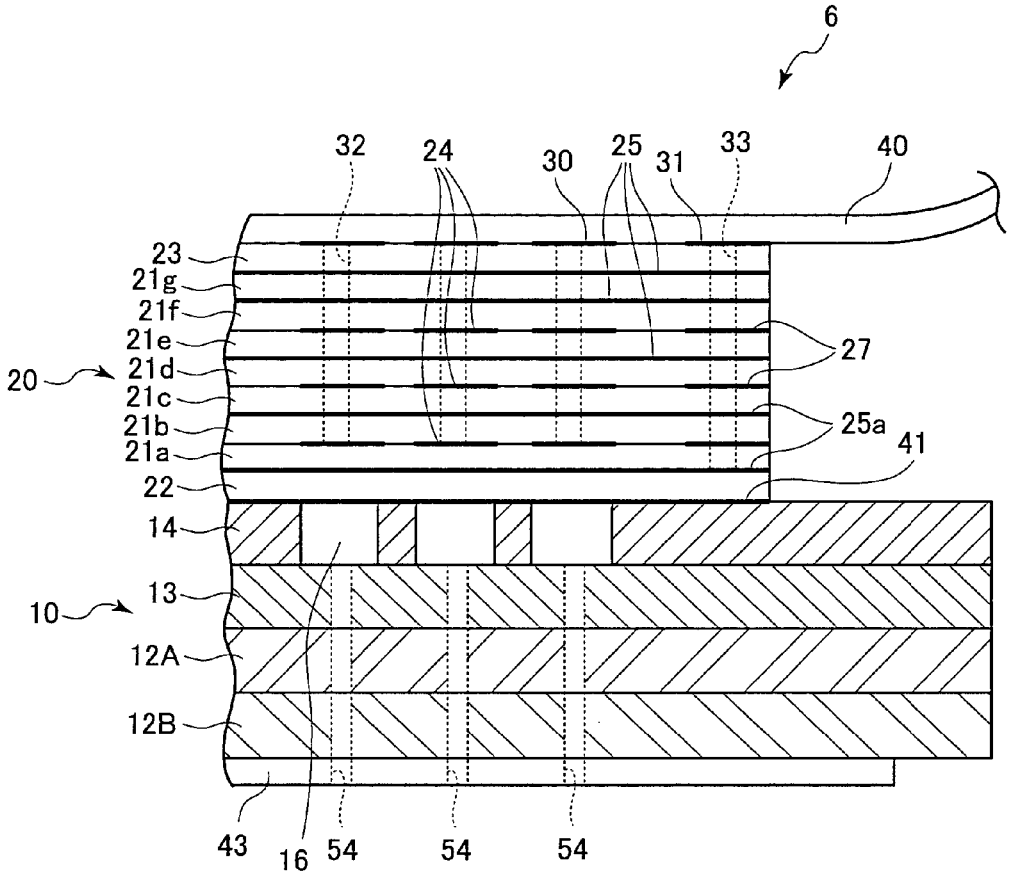
FIG. 12 is a cross-sectional view of the inkjet print head taken along a line XII—XII of FIG. 5.

Then, the bottom surface of the piezoelectric sheet 22 is fixedly adhered onto the cavity unit 10 such that the drive electrodes 24 vertically align with the pressure chambers 16 as shown in FIG. 12. Here, the adhesive sheet 41 covers all the pressure chambers 16. The adhesive sheet 41 disposed between the piezoelectric actuator 20 and the cavity unit 10 to cover all the pressure chambers 16 functions as an impermeable membrane through which ink will not permeate, as well as strongly fixing the piezoelectric actuator 20 to the cavity unit 10.

Then, as shown in FIGS. 11 and 12, the flexible flat cable 40 is placed on top of the piezoelectric actuator 20 such that wiring pattern (not shown) on the flexible flat cable 40 is electrically connected to the surface electrodes 30 and 31. In this configuration, voltage is applied to the drive electrodes 24 via wiring pattern on the flexible flat cable 40 and the first surface electrodes 30. One end of the wiring pattern connected to the second surface electrodes 31 is connected to ground. Therefore, the common electrodes 25 connected to the second surface electrodes 31 are maintained at zero volts.

Next, a voltage greater than an ejection voltage that is applied during normal printing operations is applied across all the drive electrodes 24 and the common electrodes 25 so as to polarize portions of the piezoelectric sheets 21 sandwiched between the drive electrodes 24 and the common electrodes 25. Thus polarized portions serve as active portions, which deform in the stacked (vertical) direction D3 when the drive electrodes 24 are selectively applied with an ejection voltage.

Here, the piezoelectric sheet 21*g* and the like forming upper layers are sandwiched between the common electrodes 25 or between the common electrode 25 and the surface electrodes 30, 31, so the upper layers including the piezoelectric sheet 21*g* are not polarized. Accordingly, the piezoelectric sheet 21*g* and the like do not deform, and, instead, serve to maintain the flat condition of the piezoelectric actuator 20 while preventing the same from being heaved when subjected to sintering during manufacturing process.

As described above, the common electrode 25 only is formed on the lowest piezoelectric sheet 22, and the common electrode 25 is connected to ground. The piezoelectric sheet 21*a*, the common electrode 25, and the lowest piezoelectric sheet 22 are interposed between the cavity plate 14 and the drive electrodes 24 on the piezoelectric sheet 21*a* closest to the cavity plate 14. With this configuration, polarization does not occur between the common electrode 25 on the lowest piezoelectric sheet 22 and the cavity plate 14. This stabilizes the polarization of other piezoelectric sheets. Because the active portions of the piezoelectric actuator 20 and the pressure chambers 16 corresponding to the nozzles 54 are in alignment with one another with respect to the stacked direction D3, applying a voltage to each drive electrode 24 deforms the active portion to change the volume of the corresponding pressure chamber 16. This change in the volume of the pressure chamber 16 causes the ink in the pressure chamber 16 to be ejected as a drop from the nozzle 54, to carry out a predetermined print operation.

As described above, according to the present embodiment, the common electrode 25 on the lowest piezoelectric sheet 22 has a size that the projected contours of the drive electrodes 24 having the protruding portions 24*a* completely fall within the common electrode 25 on the lowest piezoelectric sheet 22 as viewed from the stacked direction D3. That is, the common electrode 25 on the piezoelectric sheet 22 is interposed between the cavity unit 10 and the drive electrodes 24 formed on the piezoelectric sheet 21*a*, which is the nearest drive electrodes 24 to the cavity plate 14. Also, the lead-out parts 25*b* are disposed between the cavity plate 14 and the protruding portions 24*a* closest to the cavity unit 10. Further, the lead-out parts 25*b* on the lowest piezoelectric sheet 22 are not connected to the drive electrodes 24. This configuration prevents the voltage applied to the drive electrodes 24 from leaking to the cavity unit 10, and also prevents undesirable static electricity from being generated between the common electrode 25 and the cavity unit 10 through the ink. Hence, unstable ink ejection or malfunctioning ink ejection can be avoided.

Also, the likelihood of a short circuit between the drive electrodes 24 and the cavity plate 14 is low. Therefore, it is possible to reduce the adverse effects of a short circuit, such as cracking in the piezoelectric sheets and peeling of piezoelectric sheets. Furthermore, it is not necessary to connect the cavity unit 10 to ground with an electrically conducting material in order to remove any induced voltage. Therefore, the assembly process of the inkjet head can be simplified, thereby making manufacture overall easier.

Further, forming the dummy electrodes 26 on the same plane as the common electrode 25 saves space, allowing the piezoelectric actuator 20 to be compact. The common electrode 25 is maintained at zero volts, so it is possible to prevent the voltages from being applied to the cavity unit 10 and eject ink more efficiently.

Here, it is conceivable to form a plurality of dummy electrodes 26, which are connected to the drive electrodes 24, on the lowest piezoelectric sheet 22 in the same manner as the piezoelectric sheet 21*b*, without providing the lead-out parts 25*b* on the lowest piezoelectric sheet 22. In this case, the common electrode 25 and two piezoelectric ceramic sheets 22, 21*a* are disposed between the cavity unit 10 and the drive electrodes 24 nearest the cavity unit 10. Therefore, a voltage applied to the drive electrodes 24 has very little effect on the ink within the pressure chambers 16.

In this configuration, the common electrode 25 is formed on the lowest piezoelectric sheet 22, and the dummy electrodes 26 are also formed on the same lowest piezoelectric sheet 22. Because the dummy electrodes 26 are electrically connected to the drive electrodes 24, the dummy electrodes 26 are at the same voltage as the drive electrodes 24. As the common electrode 25 is connected to ground, an electrical flow path is formed from the dummy electrodes 26 via the cavity unit 10 and the ink in the pressure chamber 16 to the lowest common electrode 25. Capacitance develops between the dummy electrodes 26 and the cavity unit 10, and between the cavity unit 10 and the lowest common electrode 25 via the ink in the pressure chamber 16. In other words, a voltage is applied to the ink in the pressure chamber 16, similar to the inkjet print head disclosed in Japanese Patent-Application Publication No. 2002-19102.

In order to solve this problem, it is also conceivable to connect the cavity unit 10 to the common electrodes 25 via an electrically conducting material, so that the cavity unit 10 and the common electrodes 25 have the same potential. However, connecting the cavity unit 10 to the common electrodes 25 via the electrically conducting material increases the number of assembly processes for the inkjet print head, and this is a restriction on the manufacturing process.

In contrast to this, according to the present invention, there is no need to provide such an electrically conducting material for preventing voltage leakage to the ink because the common electrode 25 having a large surface area within which the projected contour lines of the drive electrodes 24 fall is provided on the lowest piezoelectric sheet 22.

While some exemplary embodiments of this invention have been described in detail, those skilled in the art will recognize that there are many possible modifications and variations which may be made in these exemplary embodiments while yet retaining many of the novel features and advantages of the invention.

For example, in the above-described embodiment, the drive electrodes 24 are connected to the first electrodes 30 via the conductive paste filled in the first through holes 32, and the common electrodes 25 and the second electrodes 31 are electrically connected via the conductive paste filled in the through holes 33. However, it is unnecessary to form the through holes 32, 33 in each piezoelectric sheet. In this case, an end of each protruding portion 24*a* is extended to the side surface of the piezoelectric actuator 20, and the ends of the all protruding portions 24*a* in vertical alignment are electrically connected to the corresponding first surface electrode 30 via a connection electrode provided on the side surface of the piezoelectric actuator 20. In the same manner, the lead-out parts 25*a* of the common electrode 25 are all extended to a side surface of the piezoelectric actuator 20, and the all lead-out parts 25*a* in vertical alignment are electrically connected to the corresponding second surface electrode 31 through a connection electrode provided on the side surface of the piezoelectric actuator 20.

In the above embodiment, the adhesive sheet 41 is used to fix the piezoelectric actuator 20 to the cavity unit 10. However, first polyolefin hot melt adhesive could be coated on the surface of the piezoelectric actuator 20 and then the piezoelectric actuator 20 with the adhesive could be fixedly attached to the cavity unit 10.

What is claimed is:

1. An inkjet head comprising:

a cavity unit formed of an electrically conductive material with a plurality of nozzles and a plurality of pressure chambers in fluid communication with the corresponding nozzles; and an actuator including a plurality of sheet members laminated one on the other in a stacked direction, a plurality of drive electrodes corresponding to the pressure chambers, and a plurality of common electrodes, the plurality of drive electrodes and the plurality of common electrodes being arranged in alternation with respect to a thickness direction of the actuator, each of the drive electrodes and the common electrodes being sandwiched between corresponding sheet members, wherein portions of the sheet members sandwiched between the drive electrodes and the common electrodes serve as active portions that selectively eject ink droplets from the corresponding pressure chambers through the nozzles, wherein projected contours of all the drive electrodes fall within a projected contour of one of the common electrodes disposed closest to the cavity unit with respect to the thickness direction.

2. The inkjet head according to claim 1, wherein:

the plurality of pressure chambers are aligned in a first direction perpendicular to the thickness direction;

each of the drive electrodes has a length greater than the corresponding pressure chamber in a second direction perpendicular to both the first direction and the thickness direction, each drive electrode having a protruding portion protruding beyond the pressure chamber in the second direction;

the sheet members include first sheet members and second sheet members, each first sheet member being provided with the drive electrodes on a surface, each second sheet member being provided with one of the common electrodes on a surface;

the actuator further includes a plurality of dummy drive electrodes and conductive members, the plurality of dummy drive electrodes being formed on the surface of each second sheet member, except the second sheet member closest to the cavity unit, and corresponding to the protruding portions of the drive electrodes, the conductive members extending in the thickness direction to electrically connect the dummy drive electrodes to the corresponding protruding portions; and the projected contours of all the drive electrodes including the protruding portions fall within the projected contour of the one of the common electrodes disposed closest to the cavity unit with respect to the thickness direction.

3. The inkjet head according to claim 2, wherein each of the common electrodes has at least one lead-out portion, and the actuator further includes a plurality of dummy common electrodes each formed on the surface of each first sheet member to correspond to the lead-out portions of the common electrodes, the conductive members extending in the thickness direction to electrically connect the dummy common electrodes to the lead-out portions of the common electrodes.

4. The inkjet head according to claim 2, wherein:

the plurality of pressure chambers are aligned in a plurality of rows each extending in the first direction;

the plurality of drive electrodes are aligned in a plurality of rows each extending in the first direction in correspondence with the pressure chambers;

the protruding portions of the drive electrodes protrude outward beyond the pressure chambers in the second direction;

the common electrodes are band-shaped common electrodes extending in the first direction; and the plurality of dummy drive electrodes are aligned in the first direction along both sides of the band-shaped common electrodes except the one of the common electrodes closest to the cavity unit.

5. The inkjet head according to claim 4, wherein the one of the common electrodes disposed closest to the cavity unit with respect to the thickness direction has an area including a band-shaped portion and a plurality of protruding portions corresponding to the projected contours of the protruding portions of the drive electrodes.

6. The inkjet head according to claim 2, wherein the cavity unit is attached to one of the second sheet members.

7. The inkjet head according to claim 6, wherein the cavity unit is attached to the one of the second sheet members using a non-ink-permeable and electrically insulative adhesive.

8. The inkjet head according to claim 6, wherein the sheet members, except two of the sheet members closest to the cavity unit, are formed with through holes penetrating through the protruding portions of the drive electrodes and the dummy drive electrodes, the through holes being filled with conductive paste, the conductive paste serving as the conductive members.

9. The inkjet head according to claim 6, further comprising a flexible cable disposed on the piezoelectric actuator so as to sandwich the piezoelectric actuator between the flexible cable and the cavity unit, wherein each of the common electrodes is connected to ground via the flexible cable.

10. The inkjet head according to claim 1, wherein the sheet members are piezoelectric ceramic sheets.

11. The inkjet head according to claim 1, wherein plural ones of the drive electrodes located closest to the cavity unit confront the cavity unit with more than one of the sheet members interposed between the plural ones of the drive electrodes and the cavity unit.

12. An inkjet printer comprising:

the inkjet head of claim 1; and a frame that supports the inkjet head.

13. The inkjet printer according to claim 12, wherein:

the plurality of pressure chambers are aligned in a first direction perpendicular to the thickness direction;

each of the drive electrodes has a length greater than the corresponding pressure chamber in a second direction perpendicular to both the first direction and the thickness direction, each drive electrode having a protruding portion protruding beyond the pressure chamber in the second direction;

the sheet members include first sheet members and second sheet members, each first sheet member being provided with the drive electrodes on a surface, each second sheet member being provided with one of the common electrodes on a surface;

the actuator further includes a plurality of dummy drive electrodes and conductive members, the plurality of dummy drive electrodes being formed on the surface of each second sheet member, except the second sheet member closest to the cavity unit, and corresponding to the protruding portions of the drive electrodes, the conductive members extending in the thickness direction to electrically connect the dummy drive electrodes to the corresponding protruding portions; and the projected contours of all the drive electrodes including the protruding portions fall within the projected contour of the one of the common electrodes disposed closest to the cavity unit with respect to the thickness direction.

14. The inkjet printer according to claim 13, wherein each of the common electrodes has at least one lead-out portion, and the actuator further includes a plurality of dummy common electrodes each formed on the surface of each first sheet member to correspond to the lead-out portions of the common electrodes, the conductive members extending in the thickness direction to electrically connect the dummy common electrodes to the lead-out portions of the common electrodes.

15. The inkjet printer according to claim 13, wherein:

the plurality of pressure chambers are aligned in a plurality of rows each extending in the first direction;

the plurality of drive electrodes are aligned in a plurality of rows each extending in the first direction in correspondence with the pressure chambers;

the protruding portions of the drive electrodes protrude outward beyond the pressure chambers in the second direction;

the common electrodes are band-shaped common electrodes extending in the first direction; and the plurality of dummy drive electrodes are aligned in the first direction along both sides of the band-shaped common electrodes except the one of the common electrodes closest to the cavity unit.

16. The inkjet printer according to claim 15, wherein the cavity unit is attached to one of the second sheet members.

17. The inkjet printer according to claim 16, wherein the cavity unit is attached to the one of the second sheet members using a non-ink-permeable and electrically insulative adhesive.

18. The inkjet printer according to claim 13, wherein the sheet members, except two of the sheet members closest to the cavity unit, are formed with through holes penetrating through the protruding portions of the drive electrodes and the dummy drive electrodes, the through holes being filled with conductive paste, the conductive paste serving as the conductive members.

19. The inkjet printer according to claim 13, wherein the inkjet et head further includes a flexible cable disposed on the piezoelectric actuator so as to sandwich the piezoelectric actuator between the flexible cable and the cavity unit, wherein each of the common electrodes is connected to ground via the flexible cable.

20. The inkjet printer according to claim 12, wherein the sheet members are piezoelectric ceramic sheets.

21. The inkjet printer according to claim 12, wherein plural ones of the drive electrodes located closest to the cavity unit confront the cavity unit with more than one of the sheet members interposed between the plural ones of the drive electrodes and the cavity unit.

22. The inkjet head according to claim 1, wherein the one of the common electrodes disposed closest to the cavity unit confronts the cavity unit with one of the sheet members interposed between the one of the common electrodes and the cavity unit.

23. The inkjet head according to claim 1, wherein the projected contour of the one of the common electrodes disposed closest to the cavity unit includes a part that traces the projected contours of all the drive electrodes with respect to the thickness direction.

24. The inkjet head according to claim 1, wherein the one of the common electrodes disposed closest to the cavity unit with respect to the thickness direction has a shape which is substantially the same as the projected contours of all the drive electrodes.

25. The inkjet head according to claim 1, wherein:

the plurality of pressure chambers are aligned in a first direction perpendicular to the thickness direction;

each of the drive electrodes has a length greater than the corresponding pressure chamber in a second direction perpendicular to both the first direction and the thickness direction, each drive electrode having a protruding portion protruding beyond the pressure chamber in the second direction;

the sheet members include first sheet members and second sheet members, each first sheet member being provided with the drive electrodes on a surface, each second sheet member being provided with one of the common electrodes on a surface;

the actuator further includes a plurality of dummy drive electrodes and conductive members, the plurality of dummy drive electrodes being formed on the surface of each second sheet member, except the second sheet member closest to the cavity unit, and corresponding to the protruding portions of the drive electrodes, the conductive members extending in the thickness direction to electrically connect the dummy drive electrodes to the corresponding protruding portions; and the one of the common electrodes disposed closest to the cavity unit with respect to the thickness direction has an area including the projected contours of all the drive electrodes including the protruding portions.

* * * * *